United States Patent [19]

Grimes et al.

[11] Patent Number: 4,809,009

[45] Date of Patent: Feb. 28, 1989

[54] RESONANT ANTENNA

[76] Inventors: Dale M. Grimes, 2548 Sleepy Hollow Dr., State College, Pa. 16803; Craig A. Grimes, 2104 Cullen Ave., Apt. 206, Austin, Tex. 78758

[21] Appl. No.: 148,007

[22] Filed: Jan. 25, 1988

[51] Int. Cl.[4] ..... H01Q 21/00

[52] U.S. Cl. ..... 343/726; 343/728; 343/729; 343/855

[58] Field of Search ..... 343/726, 727, 728, 729, 343/730, 853, 855, 893

[56] References Cited

U.S. PATENT DOCUMENTS

| | | | |
|---|---|---|---|
| 2,297,427 | 9/1942 | Neidhardt | 343/726 |
| 2,421,032 | 5/1947 | Marchand | 343/726 |
| 2,953,782 | 9/1960 | Byatt | 343/726 |
| 3,434,145 | 3/1969 | Wells | 343/726 |
| 4,148,036 | 4/1979 | Miller | 343/788 |

FOREIGN PATENT DOCUMENTS

| | | | |
|---|---|---|---|
| 0029184 | 12/1943 | Japan | 343/726 |
| 0088407 | 7/1980 | Japan | 343/726 |

*Primary Examiner*—William L. Sikes
*Assistant Examiner*—Hoanganh Le
*Attorney, Agent, or Firm*—Buchanan Ingersoll

[57] ABSTRACT

A resonant antenna suitable for transmission and for reception over a broad range of frequencies combines electric and magnetic multipoles generated by linear and loop elements respectively. The minimum requirement is one electric and one magnetic dipole and one electric and magnetic quadrupole. The electric elements are driven in time quadrature with the magnetic elements. The elements of the minimum requirement lie in the same plane and along the same axis. The minimum number of elements for a free standing antenna is three loops and three dipoles. Maximum transmission and reception occur only in the same direction along the axis. The size of the antenna is reduced by introducing a ground conductor or plane along the antenna axis and eliminating the half elements on one side thereof and is further reduced by introducing a second ground plane normal to the first at the midpoint of its length and eliminating the quarter elements on one side.

13 Claims, 6 Drawing Sheets

RESONANT ANTENNA

BACKGROUND OF THE INVENTION

Antennae for transmission of radio signals are currently designed to match the impedance of the transmitter as well as possible for efficient use of transmitter power.

Antennae for radio reception also benefit from good impedance match to the receiver input, but efficiency is less of a concern here as receiver gain is relatively inexpensive to obtain. Nonetheless, in high frequency reception electric dipoles resonating at the frequency desired or the center of a band of frequencies to be received are widely used. For broadcast band reception and direction finding loop antennae are often used, tuned to the frequency of the desired signal. Loop antennae are rarely used with transmitters.

Presently, efficient antennae require that the ratio of radiator size to half wavelength not be much smaller than one. In the main, the size-to-wavelength ratio determines the phase difference between the antenna driving voltage and current. Resonant radiation occurs when the two are in phase; phase difference approaches 90° in existing antennae as the size-to-wavelength ratio decreases.

In existing antennae, the radiation pattern and input impedance are, respectively, weak and strong functions of the size-to-wavelength ratio. The spatial and time variation of currents on linear antennae are described by mathematical sums over an infinite number of linear electric multipoles. Relative multipolar moment magnitudes are strongly dependent upon size-to-wavelength ratio. Relative magnitudes, in turn, determine the input impedance and pattern.

Although several current antenna designs operate over a large frequency range, their fixed dimensions impose bandwidth restrictions. An example is an equiangular spiral structure where the conductors are shaped in a spiral pattern, describable as:

$$r = Ce^{a(\phi - p)} \quad (1)$$

where r and $\phi$ are the range and angle coordinates in a spiral system and C, a and p are constants. The spacing of the input terminals determines the high frequency limit, and the outer radius of the spiral arm determines the low frequency limit. The antenna responds to input signals at all frequencies between the two extremes.

SUMMARY OF THE INVENTION

Our invention comprises an antenna suitable for transmission and, in the manner to be described hereinafter, for reception over a broad range of frequencies. It is a combination of electric and magnetic multipoles generated by linear and loop elements. Resonance occurs when the needed magnitudes and phases of the different moments are achieved and does not depend on how they are achieved. Element size and driving currents may be traded off, one against the other. Resonance requires a minimum of four elements, electric and magnetic dipole and quadrupole sources. Those sources may comprise three free-standing loops and three free-standing linear dipoles or, when combined with one or two ground planes, fractions thereof. The electric elements must be driven in time quadrature with the magnetic elements as will be shown hereinafter.

Higher order matched pairs of moments may be included. The pattern depends upon the number and complexity of the elements and is independent of frequency. Within the capability of the source to supply current, the resonant radiative reactive energy automatically adjusts driving fields to extract needed currents from the source as the frequency is shifted. In this sense the antenna is adaptive.

DESCRIPTION OF PREFERRED EMBODIMENT

1. The Antenna Structure

The antenna is constructed with either wires or microelectronic conductors depending on the size and purpose of the installation. The antenna may act alone, it may lie on a conducting or ground plane or it may fit into a right-angled conducting corner. The directivity is increased with the addition of higher order multipolar sources although it increases antenna complexity.

Figure 1:
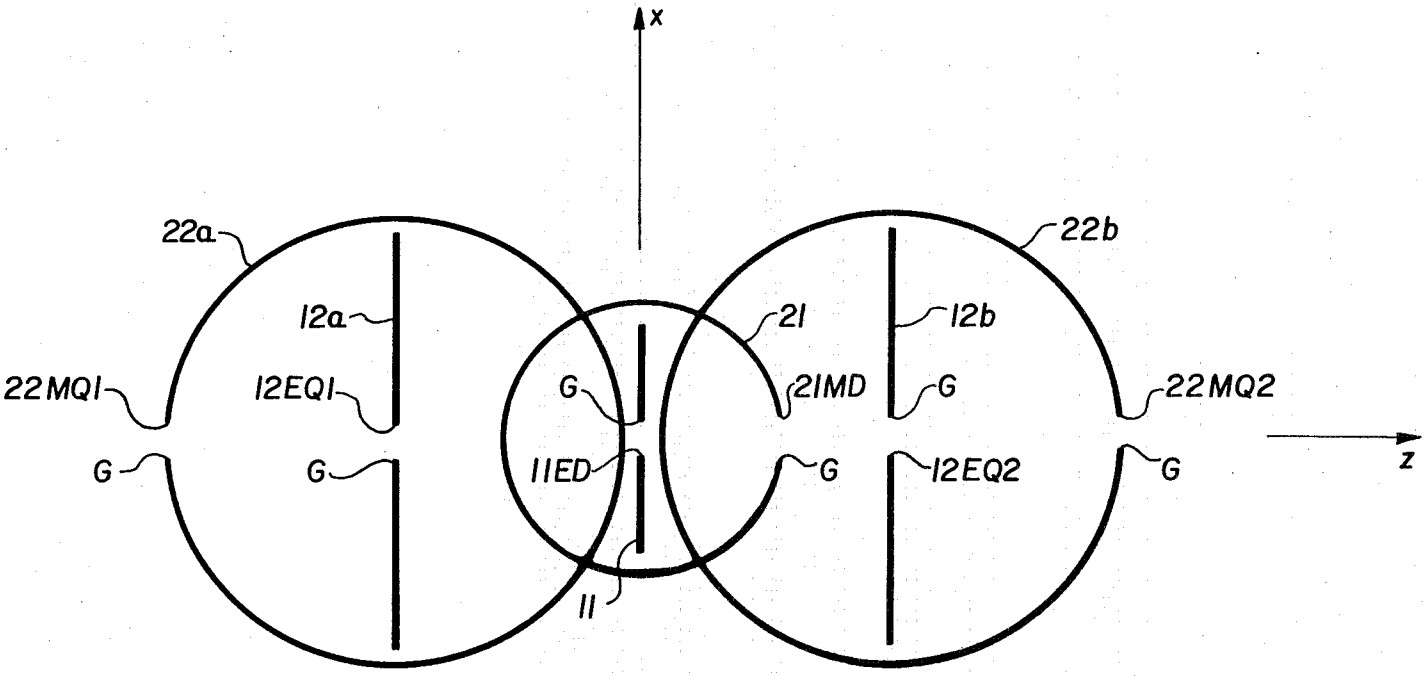
FIG. 1 is a plan of a free-standing embodiment of our invention.

FIG. 1 shows the simplest structure comprising linear electric dipoles and conducting loops each of which loops become a magnetic dipole when current flows therein. Although the loops are shown as single turns they may, of course, have multiple turns. Each element is separately connected as will be described hereinafter and each element is insulated from the others except as indicated hereinafter. Loops 22*a* and 22*b* are circular of the same size, lie in the same plane and are approximately tangent to each other at the junction of the x and z axes as shown. The y axis is normal to the x and z axes at that point. Loop 21 is centered at the same junction as is linear dipole 11 which lies on the x axis. Linear dipoles 12*a* and 12*b* are centered at the centers of loops 22*a* and 22*b* respectively and are parallel to dipole 11. The grounded terminal of each element in the figure is marked G. The other terminal of each element is marked with the appropriate reference character shown in FIG. 5. It will be understood by those of ordinary skill in the art that our antenna as shown in this figure and the following figures can be connected and operated as a balanced-to-ground system.

Currents in loops 21 and 22*b* are in phase and 180° out of phase with that of loop 22*a*. Currents in electric dipoles 12*b* and 11 are respectively in phase and 180° out of phase with that of dipole 12*a*. Currents in dipoles 12*b* and 11 are phase delayed 90° from those of loop 22*b* and loop 21.

Figure 6:
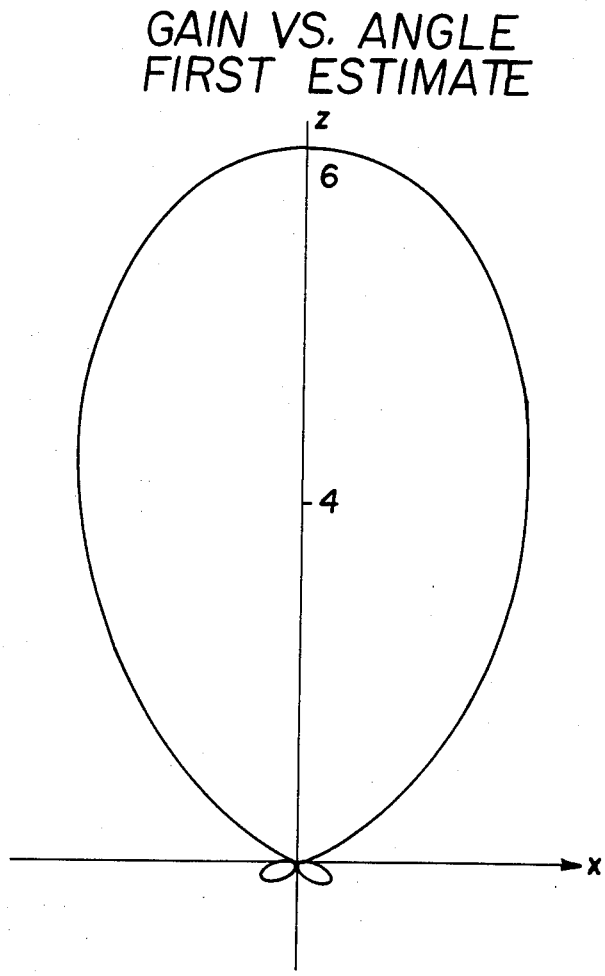
FIG. 6 is a graph of gain against angle of emission from the embodiment of FIG. 2.

When the phased currents are adjusted to the approximate magnitudes to be described hereinafter the system resonates. The radiation pattern is maximum along the positive z axis as is shown in FIG. 6.

Figure 2:
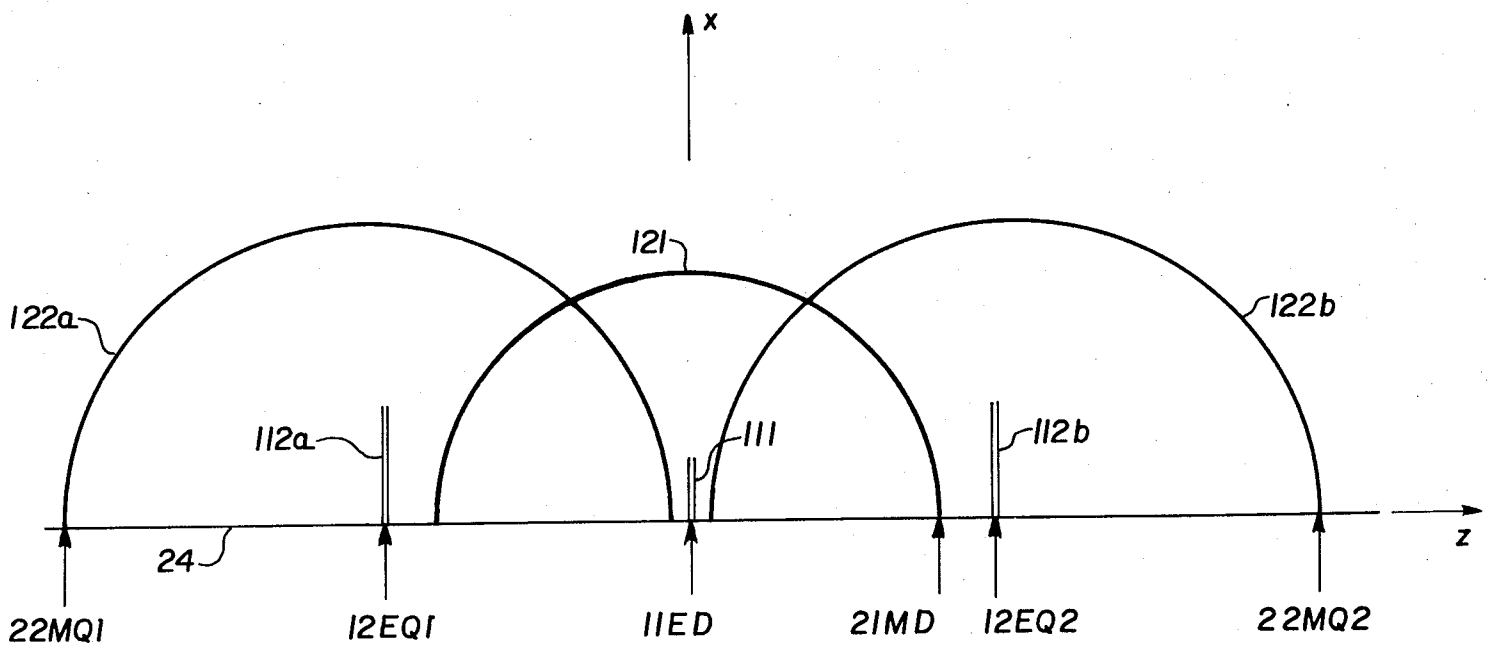
FIG. 2 is a plan of an embodiment like that of FIG. 1 but with half of each element replaced by a continuous ground plane.

The antenna may be constructed with a simpler embodiment and a lower input impedance. FIG. 2 shows that construction. The top half of the antenna is as in FIG. 1. The bottom half is replaced by a conducting ground plane 24 which, as shown, occupies the y-z plane. Since all elements are driven from below, the drives cannot interfere with the antenna. Half loops 122*a* and 122*b* are approximately tangent at plane 24 to electric half dipole 111. Half loop 121 is centered at that point. At the center of half loops 122*a* and 122 *b* are parallel electric half dipoles 112*a* and 112*b* which, when properly driven, form electric quadrupoles. In FIG. 2 the ground terminal of each element is connected to ground plane 24. The ungrounded terminal of each element is marked with the appropriate reference character shown in FIG. 5.

Figure 3:
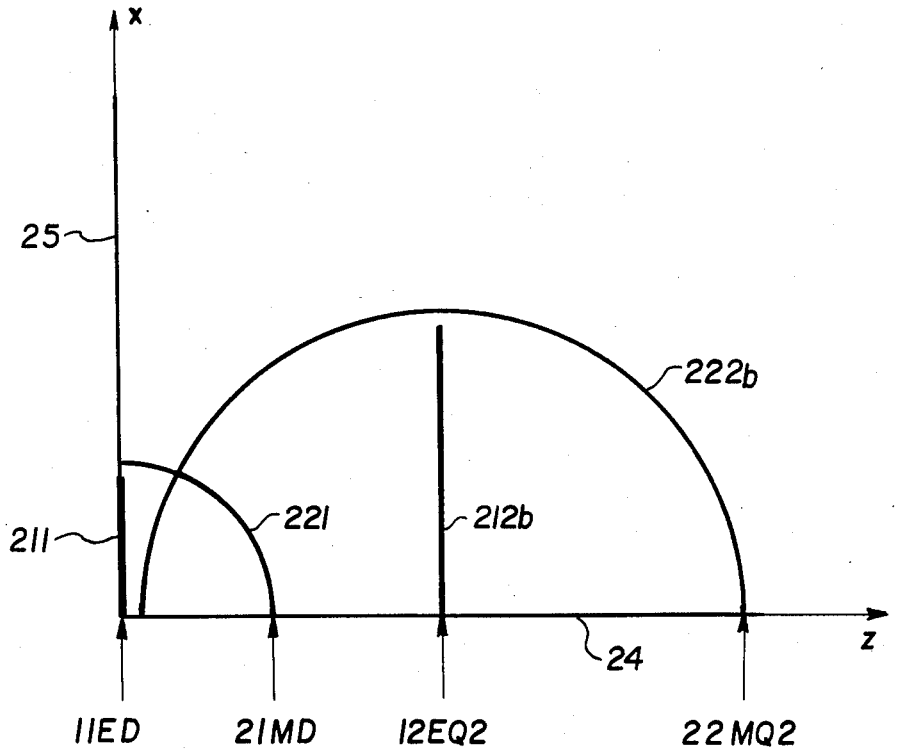
FIG. 3 is a plan of an embodiment like that of FIG. 2 but with half of the center element replaced by a second ground plane normal to the ground plane of FIG. 2.

A still simpler embodiment with still lower impedance is shown in FIG. 3, which embodiment requires two ground planes 24 and 25 normal to each other. Half loop 222*b* is approximately tangent at one end to ground plane 25. Quarter loop 221 is centered at the intersection of ground planes 24 and 25. Linear element 212*b* is normal to ground plane 24 at the center of half loop 222*b* and is a half-dipole. Linear element 211 adjacent ground plane 25 is also a half-dipole. As before, the grounded terminal of each element is connected to either ground plane 24 or ground plane 25 and the ungrounded terminal of each element is marked with the appropriate reference character shown in FIG. 5.

The dimensional and current symbols used hereinafter are as follows:

$a_1$=radius of loop 21

$a_2$=radius of loops 22*a*, 22*b* b=radius of smallest sphere which surrounds the antenna $\lambda$=wavelength of emitted radiation $L_1$=length of linear element 11

$L_2$=length of linear elements 12*a* and 12*b*

$L_3=2a_2$ $I_{11}$=current in element 11

$I_{12}$=current in elements 12*a* and 12*b*

$I_{21}$=current in loop 21

$I_{22}$=current in loops 22*a*, 22*b*

2. Driving Currents

Table I relates current phases and magnitudes needed to achieve resonance. Our analysis is based upon spherical radiators and the current ratios set out therein are necessarily approximate. The values of the ratios are obtained from equation (20) set out hereinafter.

TABLE I

Current Dependance on Parameters
Illustrative Starting Condition

| Condition | $a_2 = b/2$ | | $L_3 = b$ | | $L_1 = \frac{9\pi^2 b}{1000}$ | | $\lambda = 50b$ |
|---|---|---|---|---|---|---|---|
| | $a_1 = \frac{3b}{2\sqrt{10}}$ | | | | $L_2 = \frac{\pi^2 b}{100}$ | | |
| $I_{11}/I_{22}$ | $\frac{9i\pi^2 bL_3}{20\lambda L_1}$ | = | $\frac{9i\pi^2 b^2}{20\lambda L_1}$ | = | $\frac{150b}{\lambda}$ | = | 1 |
| $I_{21}/I_{22}$ | $\frac{L_3}{b}$ | = | 1 | = | 1 | = | 1 |
| $I_{12}/I_{22}$ | $\frac{i\pi^2 b^2}{2\lambda L_2}$ | = | $\frac{i\pi^2 b^2}{2\lambda L_2}$ | = | $\frac{150b}{\lambda}$ | = | 1 |

Although the values of Table I may be useful for many embodiments, at times it may be more convenient to construct $L_1=2a_1$ and $L_2=2a_2$. Then reactive energy minimization is sufficient to spatially modulate the magnetic currents and cause them to emit the needed electric multipole radiation. For that case, the last two columns of Table II below replace those of Table I.

Generally speaking, the values of Table I describe an easily resonated antenna and the values of Table II describe an easily constructed one.

TABLE II

Current Dependence on Parameters
Illustrative Easy-tuning Conditions $\lambda = 50b$
$L_1 = 2a_1$
$L_2 = 2a_2$ $$\frac{I_{11}}{I_{22}} = \frac{3i\pi^2 b}{2\lambda\sqrt{10}} = \frac{3i\pi^2}{100\sqrt{10}} = 10.0936$$

$$\frac{I_{21}}{I_{22}} = 1 = 1$$

$$\frac{I_{12}}{I_{22}} = \frac{i\pi^2 b}{2\lambda} = \frac{i\pi^2}{100} = 10.0987$$

3. Radiation Onset

Figure 4:
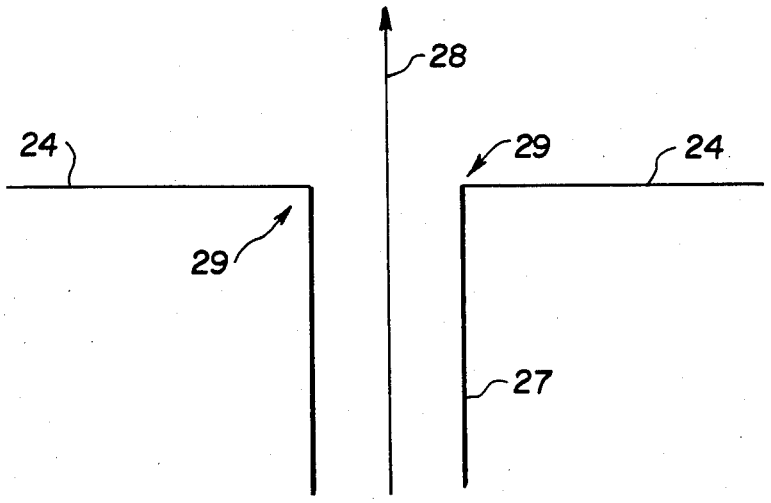
FIG. 4 is a schematic detail of the junction between a ground plane and a coaxial feed cable passing therethrough.
Figure 5:
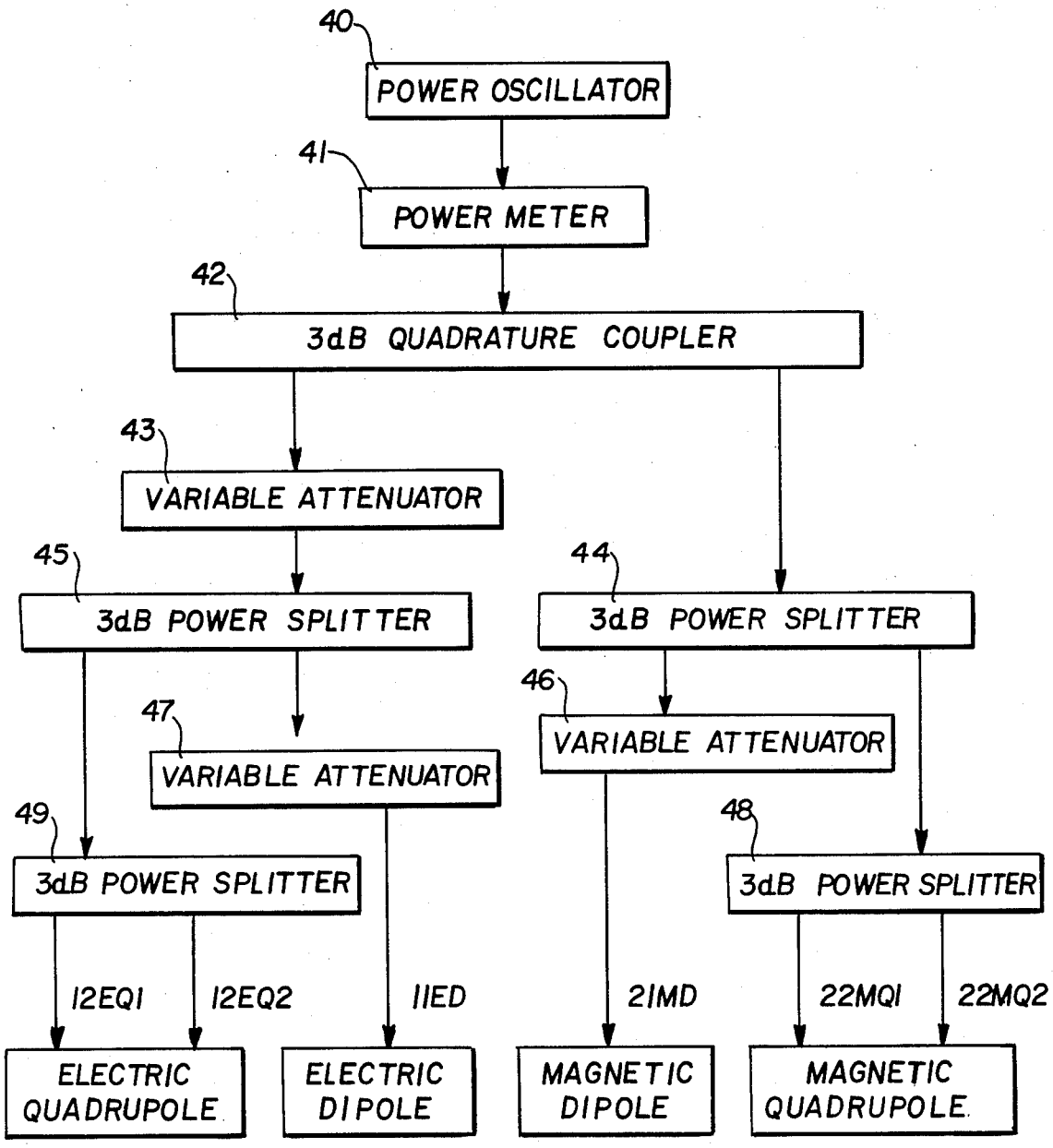
FIG. 5 is a block schematic of apparatus arranged to feed the embodiment of FIG. 1.

FIG. 5 shows the flow diagram for the driving currents in a grounded system. FIG. 2 shows the antenna elements. The ground terminals of each piece of apparatus are connected together and to the ground of the antenna array and are not shown. Each current feed is through a separate line. For coaxial lines, the feeds penetrate the conducting plane in the manner shown in FIG. 4. There the outer conductor 27 of the coaxial line is soldered at 29 to the conducting plane 24 and center conductor 28 of the coaxial line passes through that plane.

For transmission, starting with the power oscillator 40, the signal passes through the power meter 41 to 3 dB time quadrature coupler 42, outputs of which are $\pi/2$ out of phase. A 3 dB coupler splits the power evenly between both outputs. From quadrature coupler 42, the signal passes down the right leg to 3 dB power splitter 44 and continues down the right leg from that splitter to 3 dB splitter 48. From that splitter the power divides between loops 122a and 122b connected as a magnetic quadrupole. The signal on the left leg of power splitter 44 passes through variable attenuator 46 to loop 121 forming the magnetic dipole. The signal on the left leg of quadrature coupler 42 passes through variable attenuator 43 into power splitter 45. The signal on the left leg of 3 dB power splitter 45 passes through 3 dB splitter 49 and from there the split halves go to both halves of elements 112a and 112b forming the electric quadrupole. The signal on the right leg of 3 dB power splitter 45 passes through variable attenuator 47 to element 111, the electric dipole.

The drive positions of all elements are offset enough to be noncontacting.

Radiation is started in the manner described below. Values listed in the final columns of Table I are used for illustrative purposes only.

1. With attenuators 43, 46 and 47 set at maximum attenuation, adjust the power oscillator 40 to a low power level. The magnetic quadrupole formed by elements 122a and 122b is energized. Estimated initial input impedance is i24 Ω. Record the power meter reading.

2. Adjust variable attenuator 43. This energizes the electric quadrupole elements. Estimated initial input impedance is −i6000 Ω. Adjust variable attenuator 43 to maximum on power meter 41. Record the reading.

3. Adjust variable attenuator 46. This energizes the magnetic dipole 121. Estimated initial input impedance is i48 Ω. Adjust variable attenuator 46 to maximum on power meter. Record the reading.

4. Adjust variable attenuator 47. This energizes the electric dipole element 111. Estimated initial input impedance is −i3000 Ω. Iterate variable attenuators 46 and 47 for maximum power meter reading.

5. Iterate attenuators 43, 46 and 47 for maximum reading on the power meter 41. Resonance onset initiates a low radiation impedance. For example, conditions of Table I present a resonant input impedance of (0.0493+i0)Ω, see Table III.

After completing the above procedures, adjust the level of the power oscillator as desired.

1. The frequency may be swung over a range limited only by the ability of the source to supply the required current ratios of Table I.

2. With element sizes of Table II, once the antenna is started, attenuator 43 may be returned to full attenuation since the adaptive nature of the reactive energy spatially modulates currents 121a, 122a and 122b and produces the needed electric moments.

3. Often the attainable frequency sweep is limited by the bandwidth of the non-antenna subunits.

4. The Bandwidth

Working with spherical antennae, the radiative Q (see "QUANTUM THEORY AND CLASSICAL, NONLINEAR ELECTRONICS", Dale M. Grimes, Physica 20D (1986) 285–302, North-Holland, Amsterdam) satisfies the equation $$Q(\sigma) = \frac{\left|\frac{F_1^2}{3} - 6F_1F_2\left(1 - \frac{1}{\sigma^2}\right) - \frac{9}{5}F_2^2\left(1 + \frac{6}{\sigma^2}\right)\right|}{\sigma^3\left[\frac{F_1^2}{3} + \frac{9F_2^2}{5}\right]} \quad (2)$$

where the vertical lines denote absolute value, and $\sigma$=kb. k is the wave number of the radiation, and b, as before, is the radius of the smallest sphere which just surrounds the antenna. $F_1$ and $F_2$ are respectively, the dipolar and quadrupolar field parameters.

For a fixed frequency, $\sigma=\sigma_o$, radiation is optimized when $Q(\sigma)=0$, and that occurs when $$\frac{F_2}{F_1} = \frac{5}{9} - \frac{16\sigma_o^2}{27} \quad (3)$$

Substituting (3) into (2) shows, for $\sigma$ and $\sigma_o$ small, that $Q(\sigma, \sigma_o)$ is $$Q(\sigma,\sigma_o) = \frac{4}{\sigma^5}\,\frac{\sigma_o^2 - \sigma^2}{1 - 4\sigma_o^2/3} \quad (4)$$

The bandwidth lies between $\sigma$ values for which Q=1. Using the values of Table I, it is calculated to be $$BW = 0.049\% \quad (5)$$

since the instantaneous bandwidth is small, and since the range through which it is swept is large, the antenna is particularly useful for continuous carrier frequency uses. Examples are amplitude or frequency modulated signals. It presents a small scattering cross section to radar frequencies outside of its narrow center band.

5. Radiation Resistance

Equations (21) show the resistance of each of the elements at resonance, as calculated for a spherical antenna. Table III lists values of radiation resistance for the size parameters of Table I.

TABLE III

Radiation Resistance at Resonance
Quadrupolar Resistances Based Upon Elements Driven in Parallel

| Element | Same as Table I | | λ = 50b | ±5% BW |
|---|---|---|---|---|
| $R_{11}$ | $\frac{\eta L_1^2}{6\pi b^2} = \frac{27\eta\pi^3}{2{,}000{,}000}$ | = | 0.158 Ω | 0.158 Ω |
| $R_{21}$ | $\frac{27\eta\pi^3 b^2}{800\lambda^2} = \frac{27\eta\pi^3 b^2}{800\lambda^2}$ | = | 0.158 Ω | 0.143 to 0.174 Ω |
| $R_{12}$ | $\frac{9\eta L_2^2}{80\pi b^2} = \frac{9\eta\pi^3}{800{,}000}$ | = | 0.132 Ω | 0.132 Ω |
| $R_{22}$ | $\frac{9\eta\pi^3 b^2}{320\lambda^2} = \frac{9\eta\pi^3 b^2}{320\lambda^2}$ | = | 0.132 Ω | 0.120 to 0.146 Ω |

With the configuration of FIG. 1, the net input resonance resistance at mid-band is 0.0359 Ω. At ±5% either side of midband, the resistance is 0.0344 Ω and 0.0377 Ω, respectively. Since the same currents produce only half the power using the configuration of FIG. 2, and one fourth using the configuration of FIG. 3, the radiation resistances are, respectively, one half and one fourth of the listed values.

The values of Table II show a somewhat different result. Using those values of $L_1$ and $L_2$, the final two columns of Table III change to those of Table IV. Only the magnetic multipoles are driven.

TABLE IV

| Element | $L_1 = \frac{.3b}{\sqrt{10}}$ $L_2 = b$ | | $\lambda = 50b$ |
|---|---|---|---|
| $R_{21}$ | $\frac{27\eta\pi^3 b^2}{800\lambda^2}$ | = | 0.316 Ω |
| $R_{22}$ | $\frac{9\eta\pi^3 b^2}{320\lambda^2}$ | = | 0.263 Ω |

With the parameters of Table IV, the radiation resistance is about twice that of Table III.

6. Moment Evaluation

The field parameters $F_1$ and $F_2$ needed for resonance are described in "QUANTUM THEORY AND CLASSICAL, NONLINEAR ELECTRONICS", Dale M. Grimes, Physica 20D (1986) 285–302, North-Holland, Amsterdam, Equation 2. Multipolar moments are discussed in many references, including, for example, the book "Classical Electricity and Magnetism," 2nd ed., W. Panofsky and M. Phillips, Addison-Wesley Publishing Co., 1962, p. 15. With p and m respectively representing the electric and magnetic terms, the field coefficients satisfy equation (6):

$$p_1 = -\frac{4\pi\epsilon b}{k^2} F_1 \quad m_1 = -\frac{4\pi b}{\eta k^2} F_1 \qquad (6)$$

$$p_1 = -\frac{8\pi\epsilon b^2 F_2}{k^2} \quad m_2 = -\frac{8\pi b^2 F_2}{\eta k^2}$$

where $\epsilon$ and $\eta$ are, respectively, the permittivity and impedance of space. Equation (6) shows that $$m_1/p_1 = m_2/p_2 = c \qquad (7)$$

where c is the speed of light. The moments and sources are related by multipolar theory. The electric dipole has length $L_1$ extended along the x-axis and supports current $I_{11}$ oscillating at frequency $f=\omega/2\pi$. The magnetic dipole has peripheral current $I_{21}$ around loop area $S_1$, with its normal along the y-axis, and oscillates at the same frequency. The dipolar moments are $$p_1 = I_{11}/(i\omega) m_1 = I_{21} S_1 \qquad (8)$$

where $i^2=-1$ represents a phase different of 180°. Combining equations (7) and (8) leads to $$\frac{I_{11}}{I_{21}} = \frac{ikS_1}{L_1} \qquad (9)$$

The electric dipole is x-directed and the magnetic dipole is y-directed.

Quadrupolar moments are constructed by combining dipolar ones. For an electric quadrupole, take two identical dipolar units of length $L_2$, drive them with currents $I_{12}$, 180° out of phase, and separate them a distance $L_3$ in the z-direction. For a magnetic quadrupole take two identical magnetic dipolar units of area $S_2$, drive them with currents $I_{22}$, 180° out of phase, and separate them a distance $L_3$ in the z-direction. The resulting quadrupole moments are $$p_2 = \frac{L_2 L_3 I_{12}}{i\omega} \quad m_2 = L_3 S_2 I_{22} \qquad (10)$$

Combining equations (7) and (10) shows that:

$$\frac{I_{12}}{I_{22}} = \frac{ikS_2}{L_2} \qquad (11)$$

Taking the ratio of the quadrupole and dipole terms by use of equations (6), (8) and (10) shows that:

$$\frac{p_2}{p_1} = \frac{m_2}{m_1} = \frac{2bF_2}{F_1} \qquad (12)$$

while comparison of equation (8) and (10) shows that:

$$\frac{p_2}{p_1} = \frac{L_2 L_3 I_{12}}{L_1 I_{11}}, \qquad (13)$$

$$\frac{m_2}{m_1} = \frac{L_3 S_2 I_{22}}{S_1 I_{21}}$$

Combination of equations (9), (11), (12) and (13) with the resonant condition $F2/F_1)=(5/9)$ shows what is needed for resonance. Table V contains the results.

TABLE V

| Current Interrelationships | |
|---|---|
| current | ratio |
| $\frac{I_{11}}{I_{22}}$ | $\frac{9ikL_3S_2}{10bL_1}$ |
| $\frac{I_{12}}{I_{22}}$ | $\frac{ikS_2}{L_2}$ |
| $\frac{I_{21}}{I_{22}}$ | $\frac{9S_2L_3}{10bS_1}$ |

Table V is the theoretical basis for Tables I and II.

7. Resonant Operation

With all moments present and coherently radiating, and with $9F_2=5F_1$ only far field terms react back upon the source. The fields are those of Table VI, and the antenna is centered at the origin of a spherical coordinate system. $\theta$ is the polar angle and $\phi$ the azimuth angle measured from the x-axis.

TABLE VI

| Fields at Resonance |
|---|
| $E_r = -3\frac{e^{-i\sigma}}{\sigma^2}\sin\theta(5\cos\theta + 1)\cos\phi$ |
| $\eta H_r = -3\frac{e^{-i\sigma}}{\sigma^2}\sin\theta(5\cos\theta + 1)\sin\phi$ |
| $E_\theta = i\frac{e^{-i\sigma}}{\sigma}(5\cos^2\theta + 4\cos\theta - 1)\cos\phi$ |
| $\eta H_\phi = i\frac{e^{-i\sigma}}{\sigma}(5\cos^2\theta + 4\cos\theta - 1)\cos\phi$ |
| $E_\phi = -i\frac{e^{-i\sigma}}{\sigma}(5\cos^2\theta + 4\cos\theta - 1)\sin\phi$ |
| $\eta H_\theta = i\frac{e^{-i\sigma}}{\sigma}(5\cos^2\theta + 4\cos\theta - 1)\sin\phi$ |

The radial Poynting vector is:

$$N = \frac{1}{2\eta\sigma^2}(5\cos^2\theta + 4\cos\theta - 1)^2 \quad (14)$$

The antenna gain versus angle is calculated to be:

$$G(\theta)=(5\cos^2\theta+4\cos\theta-1)^2/8 \quad (15)$$

FIG. 6 shows the gain as a function of angle. The fixed gain G is 9.0 dB, and the 3 dB points lie about 34.5° from the z-axis, the direction of maximum power flow. The directivity, D, is the weighted fraction of power that flows in the direction of maximum power flow. For this case, $$D=0.67 \quad (16)$$

Equations (17) show the real and reactive powers, respectively P and R.

$$p = \frac{2\pi}{\eta k^2}\left[\frac{4f^2}{3} + \frac{72F_2^2}{5}\right] \quad (17)$$

$$R = \frac{4\pi}{5\eta k^2\sigma^3}\left[5F_1^2 - 30F_1F_2\left(1 - \frac{1}{\sigma^2}\right) - 9F_2^2\left(1 + \frac{6}{\sigma^2}\right)\right]$$

The conditions for resonance are those of equation 3; inserting this into equation (17) for the real and reactive power flows at resonance we have, very nearly, $$P = \frac{128\pi F_1^2}{9\eta k^2} \quad (18)$$

$$R = 0$$

Only the real power reacts upon the source currents. The field parameters are related to the currents by the expressions:

$$F_1 = \frac{i\eta k L_1}{4\pi b} I_{11} = -\frac{\eta S_1 k^2}{4\pi b} I_{21} \quad (19)$$

$$F_2 = \frac{i\eta k L_2 L_3}{8\pi b^2} I_{12} = -\frac{\eta k^2 L_3 S_2 k^2}{8\pi b^2} I_{22}$$

Using the above equations, the current ratios are equal to:

$$\frac{I_{11}}{I_{22}} = \frac{i9\pi L_3 S_2}{5\lambda b L_1} \quad (20)$$

$$\frac{I_{21}}{I_{22}} = \frac{9S_2L_3}{10S_1b}$$

-continued $$\frac{I_{12}}{I_{22}} = \frac{i2\pi S_2}{\lambda L_2}$$

These are the initial values of Table I. The radiation impedance of each element is purely resistive, and is calculated from the power radiated per mode. Values are for quadrupole elements driven in parallel.

$$R_{11} = \frac{\eta L_1^2}{6\pi b^2} \quad (21)$$

$$R_{21} = \frac{2\pi\eta S_1^2}{3b^2\lambda^2}$$

$$R_{12} = \frac{9\eta L_2^2 L_3^2}{20\pi b^4}$$

$$R_{22} = \frac{9\pi\eta L_3^2 S_2^2}{5b^4\lambda^2}$$

The directionality properties of this antenna are unique. Referring to FIG. 1, with phases adjusted so the antenna, when transmitting, transmits into the positive z direction, when receiving it receives from the negative, not the positive, z direction. That is, interacting radiation travels through the antenna in the same direction whether it be receiving or transmitting.

8. Greater Directivity

Figure 7:
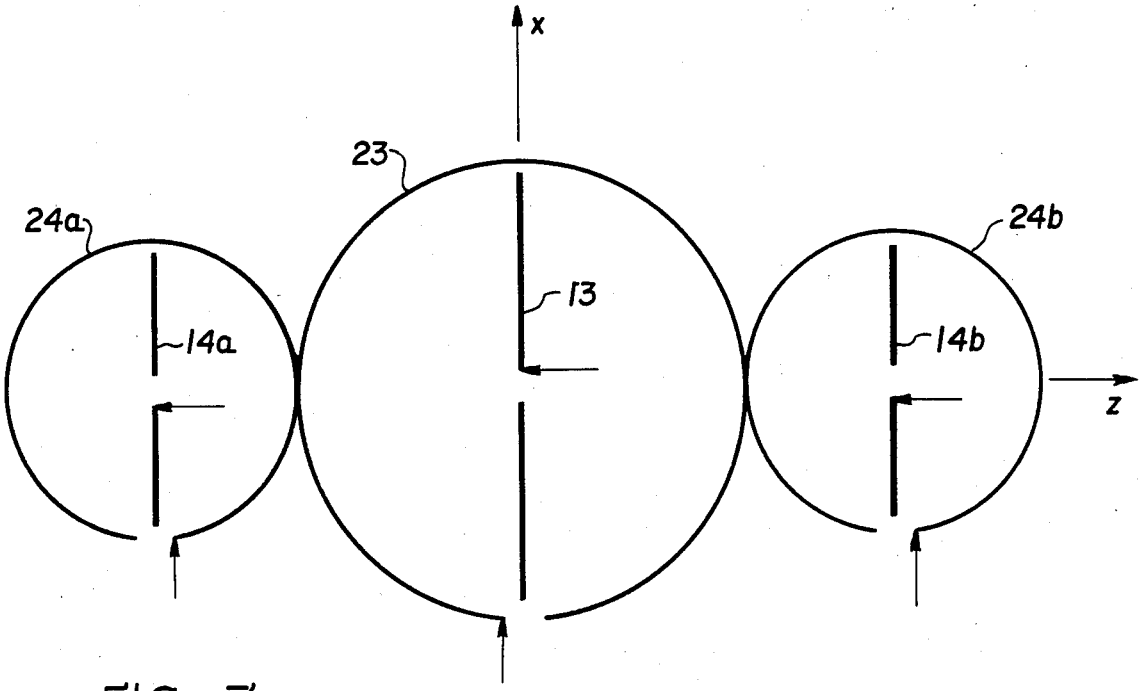
FIG. 7 is a plan of elements to be added to those of FIG. 1 to form a second free standing embodiment of our invention.
Figure 8:
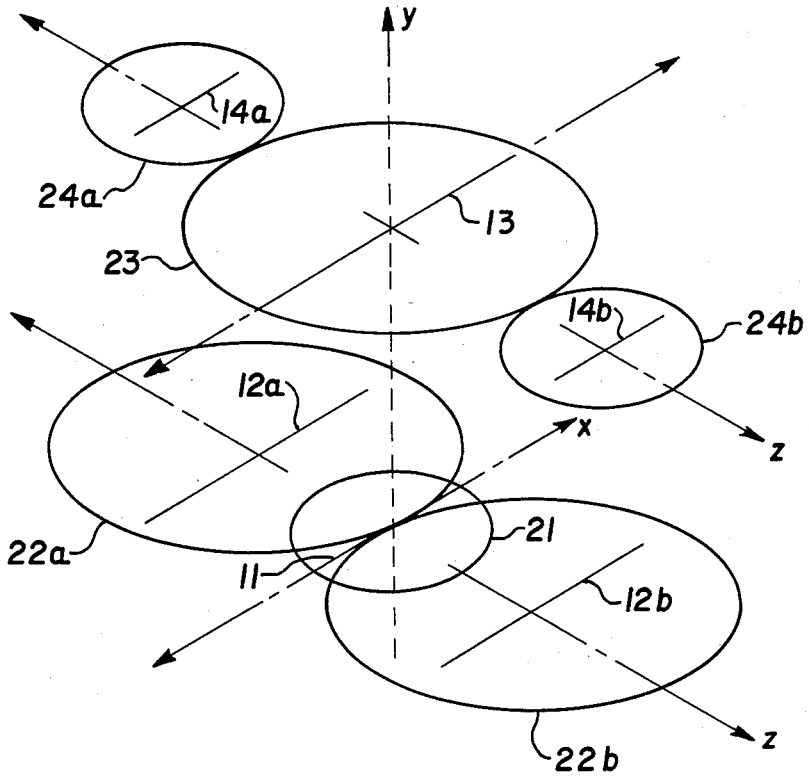
FIG. 8 is an isometric sketch of a second free-standing embodiment of our invention.

The directivity of the antenna is increased at the price of increased physical complexity. The embodiment of FIG. 2 contains only dipoles and quadrupoles and has directivity D=0.67, see equation (16). Proper inclusion of octupoles raises the directivity to 0.83, and a gain of 11.1 dB. FIG. 7 shows the needed additional elements: three loops and three lines. Loops 24*a* and 24*b* have radius $a_3$ and loop 23 has radius $2a_3$. Linear elements 14*a* and 14*b* have length $L_4$ and 13 has length $2L_4$. Currents in 24*a* and 24*b* are in phase, each out of phase with current in 23. Currents in 14*a* and 14*b* are in phase, each out of phase with current in 13. The ungrounded terminals are indicated by arrows as in FIG. 2. All elements are superimposed on those of FIG. 1, as is shown in FIG. 8, with minimum spacing. The various elements are connected to the driving apparatus of FIG. 5 in the same way as those of the antenna structures of FIGS. 1 and 7. Doing so the radiative $Q(\sigma)$, equation (2) as extended, is $$Q(\sigma) = \frac{\left|\frac{F_1^2}{3} - 6F_1F_2\left(1 - \frac{1}{\sigma^2}\right) - \frac{9F_2^2}{5}\left(1 + \frac{6}{\sigma^2}\right) - 6F_1F_3\left(3 + \frac{10}{\sigma^2}\right) - 18F_2F_3\left(4 + \frac{6}{\sigma^2} - \frac{45}{\sigma^4}\right) - \frac{90F_3^2}{7}\left(2 + \frac{30}{\sigma^2} + \frac{225}{\sigma^4}\right)\right|}{\sigma^3\left[\frac{F_1^2}{3} + \frac{9F_2^2}{5} + \frac{36F_3^2}{7}\right]} \quad (22)$$

Resonance occurs when Equation (3) is met and when:

$$\frac{F_3}{F_1} = \frac{7}{45}\left(1 - \frac{22\sigma^2}{15}\right). \quad (23)$$

Under these conditions, the directivity D is $$D = 0.83 \quad (24)$$

Antenna starting and operating procedures are parallel with those described previously. The octupolar modes are energized after resonance has been initiated in the dipolar and quadupolar elements. As before, attenuation values are iterated for maximum power output. Alternatively, the more directive embodiment may be created without loop 23 and linear element 13. Instead current drives on loop 21 and linear element 11 are re-iterated for maximum performance.

9. Equipment List

Hewlett Packard (HP) model numbers are listed for convenience only. Actual instrumentation will depend upon the frequency range over which the antenna is to operate, and whether or not conducting planes are used.

1. Power Splitters. At microwave frequencies, a Magic T provides in phase and out of phase power splitting output ports. With microelectronic construction, a Rat Race provides the same service. An off-the-shelf HP product is its unit HP 11667A or B, a device listed as being functional from DC to about 18 GHz.

2. Power meter. A power meter attached to a directional coupler is adequate to read directional power flow. An HP 89025 is adequate over the frequency range 150 kHz to 26.5 GHz.

3. Variable Attenuator. HP 84948, functional from DC to 18 GHz with variation from 0 to 11 db, and HP 8495B, functional over the same frequency range with an operational range of 0 to 70 dB are adequate.

4. Sweep oscillator. Model HP 8350 with plug-in HP 83540A provides 10 mW output power over the frequency range 10 MHz to 40 GHz. A separate power amplifier is necessary for higher power operation.

5. Phase delays. Passive circuit elements are convenient at low frequencies. Additional length of line provides needed phase changes at high frequencies.

We claim:

1. A planar antenna system comprising first loop means connected as a magnetic quadrupole, second loop means connected as a magnetic dipole, first linear means connected as an electric quadrupole, second linear means connected as an electric dipole, and means for driving said magnetic quadrupole and said magnetic dipole in time quadrature with said electric quadrupole and said electric dipole.

2. The antenna system of claim 1 in which said first loop means comprise two separately driven, substantially identical closed loops positioned adjoining each other and said first linear means comprise two separately driven, substantially identical parallel dipoles positioned symmetrically at the centers of said first loops respectively.

3. The antenna system of claim 2 in which said second loop means comprise a single closed loop centered midway between said first loop means, and said second linear means comprise a single dipole parallel to said substantially identical parallel dipoles positioned midway between them.

4. The antenna system of claim 2 including a third separately driven single loop spaced from said second loop means broadside thereto, two separately driven fourth loops spaced respectively from said first loop means broadside thereto and tangent to said third loop, a third dipole spaced from said first dipole parallel thereto, and two separately driven fourth dipoles spaced from said first dipoles and parallel thereto and means for driving said fourth loops in phase, each out of phase with said third loop, and for driving said fourth dipoles in phase and out of phase with said third dipole.

5. The antenna system of claim 1 including a first grounded linear conductor and in which said first and second loop means are fractional loops abutting at at least one end said grounded linear conductor but insulated therefrom, said first and second linear means are half dipoles abutting at their halfpoints said first grounded linear conductor but insulated therefrom and said driving means are insulated from said first grounded linear conductor.

6. The antenna system of claim 5 including a second grounded linear conductor disposed normal to said first grounded linear conductor to form a corner and in which said first fractional loop means are a single half loop tangent at one end to said second grounded linear conductor, said second fractional loop means are a quarter loop abutting said second grounded linear conductor at its other end but insulated therefrom and said second linear means are a half dipole adjacent to said second grounded linear conductor and connected thereto only at its end opposite its half point.

7. The antenna system of claim 6 in which said half loop, said quarter loop and said first and second linear means are all in a plane defined by said first and second grounded linear conductors.

8. The antenna system of claim 5 in which said fractional loops are half loops defined by said grounded linear conductor and said half dipoles are at right angles to said grounded linear conductor.

9. The antenna system of claim 5 in which said fractional loops and said half dipoles are on the same side of said first grounded linear conductor.

10. The antenna system of claim 1 in which said first and second loop means and said first and second linear means are all centered on the same line and said first and second linear means are at right angles to said line.

11. The antenna system of claim 1 in which the means for driving said magnetic quadrupole and said magnetic dipole in quadrature with said electric quadrupole and said electric dipole comprise a time quadrature coupler, a first power splitter connected to a first output of said quadrature coupler, a second power splitter connected to a first output of said first power splitter, means connecting the two outputs of said second power splitter to said electric quadrupole and said electric dipole respectively, a third power splitter connected to a second output of said quadrature coupler, means connecting a first output of said third power splitter to said magnetic dipole, a fourth power splitter connected to a second output of said third power splitter, means connecting a first output of said fourth power splitter to said magnetic dipole and means connecting a second output of said fourth power splitter to said magnetic quadrupole.

12. The antenna system of claim 11 including a first variable attenuator connected between said first output of said quadrature coupler and said first power splitter, a second variable attenuator connected between said second output of said first power splitter and said electric dipole and a third variable attenuator connected between said first output of said third power splitter and said magnetic dipole.

13. A double planar antenna system comprising in a first plane first loop means, second loop means, first linear means, second linear means and in a second plane parallel to said first plane, third loop means connected with said first loop means as a magnetic octupole, fourth loop means connected with said second loop means as a magnetic quadrupole, third linear means connected with said first linear means as an electric octupole, fourth linear means connected with said second linear means as an electric quadrupole, and means for driving said magnetic octupole and said magnetic quadrupole in time quadrature with said electric octupole and said electric quadrupole.

* * * * *

UNITED STATES PATENT AND TRADEMARK OFFICE

CERTIFICATE OF CORRECTION

PATENT NO. : 4,809,009

DATED : February 28, 1989

INVENTOR(S) : DALE M. GRIMES, CRAIG A. GRIMES

It is certified that error appears in the above-identified patent and that said Letters Patent is hereby corrected as shown below:

Column 8, line 1, Formula (10) change

"$p_2 = \frac{L_2 L_3 L_{12}}{iw} m_2 = L_3 S_2 I_{22}$" to

--$p_2 = \frac{L_2 L_3 I_{12}}{iw} m_2 = L_3 S_2 I_{22}$--

Column 9, line 20, Formula (17) change

"$p = \frac{2\pi}{\eta k^2}\left[\frac{4f^2}{3} + \frac{72F_2{}^2}{5}\right]$" to --$p = \frac{2\pi}{\eta k^2}\left[\frac{4F_1{}^2}{3} + \frac{72F_2{}^2}{5}\right]$--

Column 9, line 45, Formula (19) change

"$F_2 = \frac{i\eta k L_2 L_3}{8\pi b^2} I_{12} = -\frac{\eta k^2 L_3 S_2 k^2}{8\pi b^2} I_{22}$ to --$F_2 = \frac{i\eta k L_2 L_3}{8\pi b^2} I_{12} = -\frac{\eta k^2 L_3 S_2}{8\pi b^2} I_{22}$--

Signed and Sealed this

Twenty-fourth Day of October, 1989

*Attest:*

DONALD J. QUIGG

*Attesting Officer*

*Commissioner of Patents and Trademarks*